US008256067B2

(12) United States Patent
Kunst

(10) Patent No.: US 8,256,067 B2
(45) Date of Patent: Sep. 4, 2012

(54) BUCKLE, AND AN ASSEMBLY COMPRISING A BELT AND A BUCKLE

(75) Inventor: Ronald Fredericus Antonio Kunst, Doesburg (NL)

(73) Assignee: Artie Belts B.V., Doetinchem (NL)

( * ) Notice: Subject to any disclaimer, the term of this patent is extended or adjusted under 35 U.S.C. 154(b) by 157 days.

(21) Appl. No.: 12/531,118

(22) PCT Filed: Oct. 23, 2007

(86) PCT No.: PCT/EP2007/061333

§ 371 (c)(1),
(2), (4) Date: Dec. 2, 2009

(87) PCT Pub. No.: WO2009/052858

PCT Pub. Date: Apr. 30, 2009

(65) Prior Publication Data

US 2011/0258821 A1 Oct. 27, 2011

(51) Int. Cl.
*A44B 11/06* (2006.01)

(52) U.S. Cl. ..... 24/168; 24/170; 24/193

(58) Field of Classification Search ..... 24/168, 24/170, 178, 182, 188, 174, 191, 193, 307, 24/265 BC See application file for complete search history.

(56) References Cited

U.S. PATENT DOCUMENTS

| | | | | | |
|---|---|---|---|---|---|
| 441,848 | A | * | 12/1890 | Kemp | 54/34 |
| 621,109 | A | * | 3/1899 | Lester | 24/188 |
| 655,858 | A | * | 8/1900 | Ettinger | 54/34 |
| 939,394 | A | * | 11/1909 | Cohen | 24/168 |
| 941,242 | A | * | 11/1909 | Gardner | 24/309 |
| 1,087,065 | A | * | 2/1914 | Kaiser | 24/170 |
| 1,224,252 | A | * | 5/1917 | Wilcox | 24/168 |
| 1,897,306 | A | * | 2/1933 | Flint | 24/30.5 R |
| 3,696,471 | A | | 10/1972 | Mermelstein | |

FOREIGN PATENT DOCUMENTS

| | | |
|---|---|---|
| DE | 3431728 | 3/1986 |
| WO | 0167909 | 9/2001 |

OTHER PUBLICATIONS

International Search Report of PCT/EP2007/061333.

* cited by examiner

*Primary Examiner* — Robert J Sandy
*Assistant Examiner* — Rowland D Do
(74) *Attorney, Agent, or Firm* — Caesar, Rivise, Bernstein, Cohen & Pokotilow, Ltd.

(57) ABSTRACT

A buckle for a belt is provided including a fixation device to fix the buckle to a first end of the belt, and a guiding member configured to guide a belt part along the first belt end during use, for example to form a loop wherein the guiding member includes an operable clamping device having a releasing position to release the belt, and an engagement position to clamp a belt part to the guiding member, wherein the clamping device is configured such that when the clamping device is in the engagement position, the clamping device can be brought to its releasing position by pressing on a belt part.

12 Claims, 2 Drawing Sheets

BUCKLE, AND AN ASSEMBLY COMPRISING A BELT AND A BUCKLE

BACKGROUND OF THE INVENTION

The invention relates to a buckle for a belt.

WO2007/040383 describes a belt, comprising an elongated band that can be passed around the body and fixation means for fixing the belt in a tightened position, said fixation means comprising a series of teeth extending along a certain length on a first side of the elongated band and an engagement element provided near a first end of the elongated band, which engages one of said teeth in the tightened position for fixing the same with respect to said first end. The known belt and buckle are characterized in that the engagement element is substantially rigid in relation to the first end of the belt.

An advantage of the known belt/belt-assembly is that the belt can be tightened swiftly. However, a disadvantage is that the untightening of the belt is rather cumbersome. Particularly, the belt is to be undone, by moving a free end of the elongated band away from the body, such that the engagement element pivots with respect to the first end of the belt. When the belt worn very tight around the body, there is no space left to allow the pivoting of the belt parts.

SUMMARY OF THE INVENTION

The present invention aims to provide an improved, durable buckle, particularly to provide relatively swift handling of a belt.

According to an embodiment, there is provided a buckle for a belt, the buckle comprising:

a fixation device to fix the buckle to a first end of a belt; and a guiding member configured to guide a belt part along the first belt end during use;

wherein the guiding member includes an operable clamping device having a releasing position to release the belt, and an engagement position to clamp a belt part to the guiding member, wherein the clamping device is configured such, that when the clamping device is in the engagement position, the clamping device can be brought to its releasing position by pressing on a belt part.

This buckle can be handled in a straight-forward manner, wherein the belt can simply be released (i.e. a clamping can be undone) by pressing on a belt part. Particularly, the buckle can be operated also when the respective belt is worn tightly by the user. For example, in a non-limiting embodiment, a belt part that extends along or through the guiding member (i.e. a belt part that is guided by the guiding member) can be pressed on, to operate the clamping device.

In this application, the term "belt" should be interpreted broadly, since the belt can be any elongated member, suitable to be used in combination with the present buckle. For example, the elongated member can be a clip, a fastener, a flexible, elongated ribbon, band, rope, or another type of elongated member.

According to a further embodiment, the clamping device comprises a control member which extends behind a belt feeding passage of the buckle, wherein the control member is movable from a first to a second position to bring the clamping device from the releasing position to the belt engaging position and vice-versa. This is a preferred example that is configured to provide the above-described mode of operation for releasing the belt.

The control member can be configured in various ways. For example, according to a further embodiment the control member is spring biased. Also, according to an embodiment, the control member can be an elongated part or member, preferably having a thickness that is significantly smaller (i.e. at least 10 times smaller, preferably at least 50 times smaller) than a width of the member.

Also, according to a durable yet simple and relatively inexpensive embodiment, the control member is a spring steel. The control member can also be configured in a different manner.

According to an embodiment, the guiding member comprises a first lateral belt guiding aperture, a second lateral belt guiding aperture extending opposite the first aperture. According to a further example, the guiding member can also comprise a belt passage extending between the first and second guiding aperture (i.e., the belt passage is defined by these apertures) to feed a belt part between these apertures. In that case, preferably, a part of the belt extending through the belt passage can be reached from outside to press onto that belt part (inwardly, i.e. towards the body of a person wearing the belt), to operate the clamping device. Alternatively, for example, the guiding member can be provided with a flexible or resilient cover, covering said belt passage, in which case a pressing onto the cover can lead to operating the clamping device via a belt part extending below the cover.

The fixation device can be configured in various ways. For example, the fixation device can be configured to detachably hold a part of a belt. Also, the fixation device can be configured to hold a coupling loop of a terminal belt section, for example in case the fixation device includes a transversal pin, around which pin a belt (loop) part can be held.

Preferably, the fixation device is integrated with a first buckle part that includes the first guiding aperture, and the clamping device is integrated with a second buckle part that includes the second guiding aperture. In this way, a relatively compact, relatively slender, buckle can be provided.

A further embodiment is provided by the features of claim 7. According to this embodiment, the afore-mentioned control member extends behind the belt passage, preferably such that the control member is in mechanical contact with a belt part that reaches through the belt passage when the control member is in its second position. In this manner, a reliable handling of the control member can be achieved, simply by acting on a buckle part that extends though the respective belt receiving area (belt passage) of the guiding member.

According to a further configuration of the buckle, the clamping device can comprise a first and second clamping part, the first clamping part being pivotal with respect to the second clamping part. In that case, preferably, the control member can be configured to engage the first clamping part to control the position of the first clamping part with respect to the second clamping part. Interaction between the control member and clamping device can also be provided in a different manner, as will be appreciated by the skilled person.

The buckle as such can be shaped in various ways, and can be made of different materials, for example plastic, a metal, an alloy, steel, a composite material, of in a different manner.

Also, according to an embodiment, there is provided a buckle for a belt, the buckle comprising:

a fixation device to fix the buckle to a first end of a belt; and a guiding member configured to guide a belt part along the first belt end during use, for example to form a loop;

wherein the guiding member includes an operable clamping device having a releasing position to release the belt, and an engagement position to clamp a belt part to the guiding member, wherein the clamping device comprises a control member that is movable from a first to a second position to bring the clamping device from the releasing position to the belt engaging position and vice-versa, wherein the control member is made of spring steel, and is preferably spring biased.

By the application of a spring steel control member, a durable yet simple, compact and relatively inexpensive buckle can be provided. Preferably, as follows from the above, the clamping device can be brought to its releasing position by pressing on a belt part, however, that is not essential to the present embodiment. For example, the spring steel control member does not have to extend behind the belt passage. Besides, for example, the spring steel control member does not have to be operable by pressing on a belt part. In the latter case, for example, the buckle can include manually operable means, for example a knob or handle, that are coupled to the spring steel control member to control the state of the control member.

The present invention also provides an assembly comprising at least one belt and a buckle according to the invention.

This provides above-mentioned advantages. Preferably, the belt is to be used to be worn as a garment by a person, around the waist of the person. However, the assembly can also be applied in a different field. The belt can be made of various materials, for example leather, plastic, and/or a combination of these and/or other materials.

Besides, for example, during use, a single loop can be formed by a belt, wherein a first end of the belt is held by the fixation device of the buckle, and an opposite end of the belt is fed along the guiding member (to overlap the first belt end).

In an other embodiment, the buckle can be used in combination with a belt that is not to be looped around a user, for example in the case the belt is a seat-belt (for example of a vehicle or airplane seat). Besides, the buckle can be used in combination with two different belt sections, or for example with two different belts, wherein one of the belts (or belt sections) is held by the fixation device, and the other belt (or belt section) is engaged by the clamping device.

Besides, according to a preferred embodiment, the belt as such can be provided with friction enhancing means, to be releasable grasped by the clamping device of the buckle during operation. Such a belt is known per se (see for example WO2007/040383), wherein the friction enhancing means are not provided by holes (such as in other prior art belts), but for example by a strip of closely spaced-part teeth that protrude from a surface of the belt. The friction enhancing means of the belt can also be configured differently.

BRIEF DESCRIPTION OF SEVERAL VIEWS OF THE DRAWINGS

Embodiments of the invention will now be described, by way of example only, with reference to the accompanying schematic drawings in which corresponding reference symbols indicate corresponding parts, and in which.

DETAILED DESCRIPTION OF PREFERRED EMBODIMENTS

The present non-limiting embodiment (see FIGS. 1-6) comprises a buckle 1; the buckle may also be referred to as being a "clip", "fastener", or the-like. In a further embodiment, the buckle 1 is adapted to cooperate with a flexible, elongated belt (for example a flexible strip, ribbon, or band, or another type of belt). In the following, operation of the buckle in combination with a single belt B is described, however, the buckle can also be used in a different manner (for example, in combination with two separate elongated members).

Figure 1:
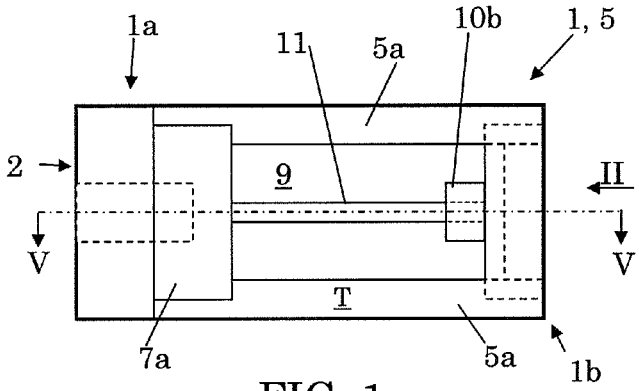
FIG. 1 depicts a top view of an example of an embodiment of a buckle.
Figure 2:
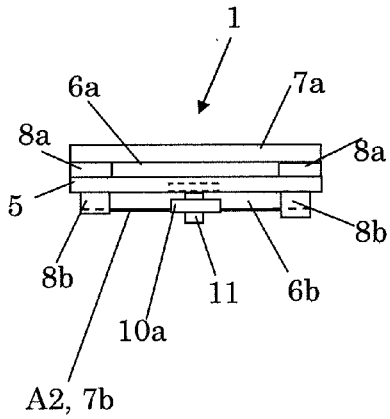
FIG. 2 depicts a front view over line II of FIG. 1.
Figure 3:
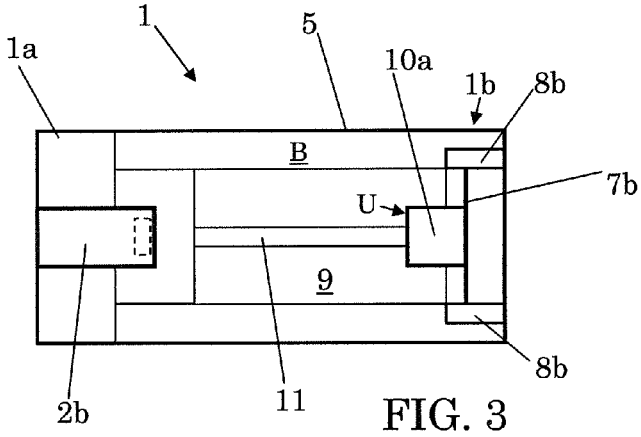
FIG. 3 depicts a bottom view of the embodiment of FIG. 1.
Figure 4:
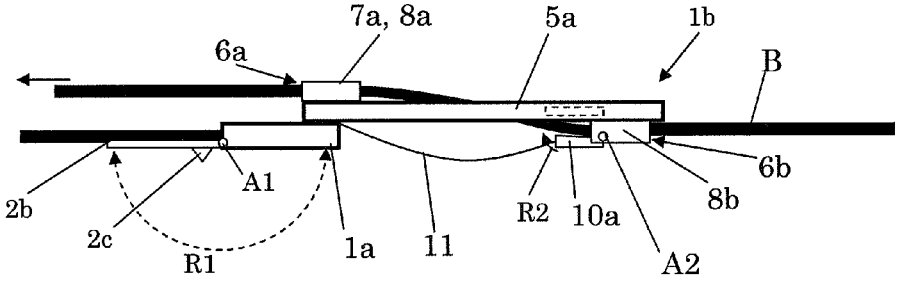
FIG. 4 depicts a side view of the embodiment of FIG. 1 in combination with part of a belt.
Figure 5:
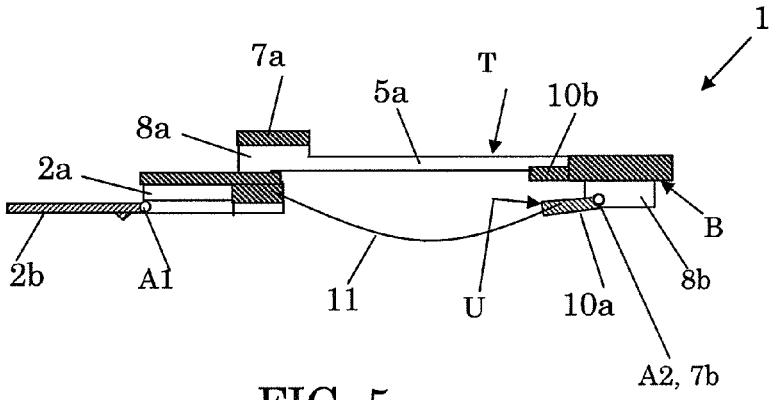
FIG. 5 is a cross-section over line V-V of FIG. 1, wherein the clamping device is an a belt releasing position.
Figure 6:
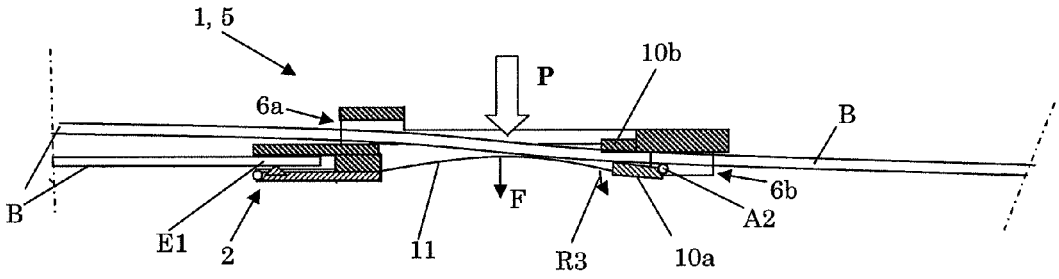
FIG. 6 is similar to FIG. 5, also showing part of a belt, when the clamping device is in a belt clamping position.

The buckle 1 can include a fixation device 2 to fix the buckle 1 to a first end of the belt. The fixation device 2 can be configured in various ways. For example, in the present embodiment, a first buckle part 1*a* is provided with the fixation device 2. The first buckle part 1*a* has a slit 2*a* (see FIGS. 5-6) to receive a first belt end E1, and a belt gripper 2*b* pivotable around a first pivot axis A1 (double arrow R1 in FIG. 4 indicates such a rotation of the belt gripper). A belt release position of the gripper 2*b* is shown in FIGS. 4, 5, and a belt holding position of the gripper 2*b* is shown in FIG. 6. In the latter position, one or more protrusions (for example teeth) 2*c* of the gripper, located near the axis A1, cooperate with the belt to firmly fix the first belt end in the slit 2*a*. The present fixation device 2 is not provided with an engagement element that is pushed towards an outside (as is the buckle of WO 2007/040383), providing a more durable construction.

The buckle 1 can comprise a guiding member 5 configured to guide a free belt part (i.e., a belt part that extends away from the first belt end) along the first belt end during use, for example to form a loop (of the belt B).

In the present embodiment, the guiding member 5 is a frame (for example a rectangular frame) that encloses a frame aperture 9 (for example a rectangular aperture, as in this embodiment).

Particularly, the guiding member (or belt guiding frame) 5 can comprise a first lateral belt guiding aperture 6*a* located on one side of the frame aperture 9 (i.e. at a first buckle part 1*a*). In the present embodiment, the fixation device 2 is integrated with a first buckle part 1*a* that includes the first guiding aperture 6*a*.

Also, the guiding member 5 can comprise a second lateral belt guiding aperture 6*b* extending opposite the first aperture 6*a*, at an opposite side of the frame aperture 9 (i.e. at a second buckle part 1*b*). In this embodiment, two parallel frame beams 5*a* connect the first and second buckle parts 1*a*, 1*b*.

The first and second aperture 6*a*, 6*b* define a belt passage there-between, to feed a belt part between the apertures 6*a*, 6*b* (and particularly along and at least partly though the frame aperture 9). Particularly, each guiding aperture 6*a*, 6*b* is defined by a respective belt guide part 7*a*, 7*b* that is spaced-apart from the frame 5, and that is connected to the frame by respective side parts 8*a*, 8*b*. Moreover, in a further embodiment (see FIGS. 1, 2, 5, 6), the first belt guide part 7*a* extends above a front surface T of the guiding member 5, and the second belt guide part 7*b* extends below a back surface C of the member 5 (the front surface T being faced away from the back surface C). Optionally (see above), a front surface T of the buckle can include a flexible or resilient covering (not shown in the drawing), configured to cover the frame aperture 9.

Preferably, the buckle 1 is mainly made in one piece, from the same material(s). For example, said belt guide parts 7*a*, 7*b*, the respective side parts 8*a*, 8*b* and the guiding member can all be made in one piece with each other, from the same material(s).

Preferably, the buckle 1 (and particularly the guiding member 5) includes an operable clamping device 10 having a releasing position (see in FIGS. 4, 5) to release the belt B, and an engagement position (see FIG. 6) to clamp a belt part to (an opposite part 1010 of) the guiding member 5.

The present clamping device 10 comprises a first and second clamping part, the first clamping part 10*a* being pivotal with respect to the second clamping part 10*b*. Arrow R2 in FIG. 4 indicates a first pivoting movement of the first part 10*a*, moving towards the second part 10*b* to narrow the gap therebetween and to grasp a belt, and arrow R3 in FIG. 6 indicates a reverse pivoting movement of the part 10*b*. The second clamping part 10*b* is an integral part of (i.e. being in one piece with) the second buckle part 1*b*.

A (second) pivot axis of the first clamping part 10*a* is indicated by reference sign A2. This second pivot axis A2 extends in parallel with respect to the pivot axis A1 of the belt gripper. Moreover, in this embodiment, the second pivot axis also serves to provide the second belt guide part 7*b*, which defines the second belt guiding aperture 6*b*. Preferably, the first clamping part 10*a* has a relatively sharp free edge U, or tooth part, to firmly grip onto the belt B (and preferably onto dedicated friction enhancing means of the belt) when the clamping device 10 is in the belt engagement position.

In the embodiment, the clamping device 10 is configured such, that when the first part 10*a* of the clamping device is in the engagement position (see FIG. 6), the clamping device 10 can be brought to its releasing position by pressing on a belt part extending along or near (i.e., being guided between the apertures 6*a*, 6*b* by) the guiding member 5. Such a pressing (or operating force) is indicated by an arrow P in FIG. 6. In an alternative embodiment, the clamping device 10 can be brought to its releasing position in a different manner, for example using an external knob or handle (see below).

In the present embodiment, the clamping device 10 comprises a control member 11 which extends behind a belt feeding passage of the buckle 1. The control member 11 is movable from a first position, shown in FIGS. 4, 5, to a second position (see FIG. 6) to pivot the first part 10*a* of clamping device 10 from the releasing position to the belt engaging position, and vice-versa.

Moreover, the present control member 11 extends behind the belt passage (and behind the frame aperture 9), preferably such that the control member 11 is in mechanical contact with a belt part that reaches through the belt passage when the control member is in its second position (as in FIG. 6).

In the embodiment of FIGS. 1-6, one end of the control member 11 is fixed to the first buckle part 1*a*. The other (opposite) end of the control member 11 is fixed to the first clamping pivotable part 10*a* of the clamping device 10. Thus, the opposite end of the control member 11 is pivotable with respect to the clamping device 10, via the first clamping part 10*a*. For example, the first clamping part 10*a* can include a slit in which an end section of the control member 11 is received and fixed.

In an alternative embodiment, the opposite ends of the control member 11 can both be pivotably coupled to respective buckle parts 1*a*, 1*b*. For example, in an alternative embodiment, the first buckle part 1*a* can also be provided with a pivotable part (not shown); the latter pivotable part can be fixed to a respective end of the control member 11, and can be pivotal about a pivot axis (not shown) that is parallel with respect to the (second) pivot axis A2 of the first clamping part 10*a*.

Particularly, the control member 11 can be arranged such as to provide a "click-clack" operation, having a first steady state (see FIG. 4) in which the control member 11 has a first curvature (viewed in side view) in a first direction, and a second steady state (see FIG. 6) in which the control member 11 has a second curvature that is opposite to the first curvature. Particularly, in its first state (see FIG. 5), a concave side of the control member 11 is faced outwardly, i.e., towards the belt passage (or a belt extending through that passage. The present control member 11 has a convex side faced outwardly, when the member 11 is in its second state (see FIG. 6).

Also, for example, the control member 11 is spring biased, particularly when the control member 11 is in its second position, in which case the spring bias of the control member 11 counteracts movement of the control member to its first position. The spring bias can be overcome by the application of said pressure P.

According to a preferred embodiment, the control member 11 is made of spring steel. In the present embodiment, the control member 11 is an elongated spring biased member or strip (of spring steel), having a thickness that is less than 1 mm, for example less than 0.5 mm, and a width of several mm, for example at least 0.5 cm. In the non-limiting embodiment, the control member 11 extends in parallel with the frame side beams 5*a*, however, this is not essential. Preferably, the control member 11 extends approximately centrally behind the belt passage, as in the present embodiment.

Thus, in the present embodiment, the control member (for example elongated steel spring part) 11 engages the first clamping part 10*a* to control the position of the first clamping part 10*a* with respect to the second clamping part 10*b*.

In the present embodiment, for example, the belt part that extends between the two apertures 6*a*, 6*b* can be pressed upon, to operate the (preferably elongated spring steel) control member 11. In an alternative embodiment (not shown), other means can be provided to operate the control member. For example, the buckle can include a knob or handle (for example extending outside the belt guiding passage, or protruding from a buckle side) that is coupled to the control member (for example via a pivotable part 10*a*, or differently), to set or adjust the control member 11 to a desired operating position.

During use, one end of a belt B can be held firmly by the belt gripper 2 of the buckle (see FIG. 6; therein, the a terminal section of the belt is located in the above-mentioned slit 2*a*, and is held by the protrusions of the gripper 2*c*, with the gripper part 2*b* being in its closed position).

Also, part of the belt B can be fed through the belt passage, to be held by the buckle 1 as well (for example to loop the belt). Another belt part can be guided from the second guiding aperture 6*b* along the belt passage to the first guiding aperture 6*a*. Preferably, but not necessarily, this is achieved with the clamping device 10 being already in its belt engagement position (as in FIG. 6), so that a swift tightening of the belt B can be obtained. A result of this operation is shown in FIG. 6.

Subsequently, the belt can be release with ease, simply by pressing on the belt part that is located in the belt passage, particularly in an inward direction (for example, in a direction towards a body of a user carrying the belt; this direction is indicated by the arrow P in FIG. 6). The pressure exerted onto (an outer surface of) the belt B leads to the belt exerting a force F onto the control member 11, urging the control member 11 from its second to its first position (as in FIG. 5). A respective movement of the control member 11 leads to pivoting the first clamping part 10*a* to a belt releasing position. After the control member 11 has "clacked" into its first position, the respective belt section is not clamped between the first and second parts 10*a*, 10*b* anymore, and can therefore be sled slid out of the buckle 1.

The descriptions above are intended to be illustrative, not limiting. Thus, it will be apparent to one skilled in the art that modifications may be made to the invention as described without departing from the scope of the claims set out below.

It is to be understood that in the present application, the term "comprising" does not exclude other elements or steps.

Also, each of the terms "a" and "an" does not exclude a plurality. Any reference sign(s) in the claims shall not be construed as limiting the scope of the claims.

While the invention has been described in detail and with reference to specific embodiments thereof, it will be apparent to one skilled in the art that various changes and modifications can be made therein without departing from the spirit and scope thereof.

The invention claimed is:

1. A buckle assembly for a belt, the buckle assembly comprising:

a buckle;

a fixation device disposed on the buckle fixing the buckle to a first end of the belt; and a guiding member having an aperture, the guiding member guiding a free belt part along the first end of the belt;

wherein the guiding member includes an operable clamping device having a releasing position releasing the belt, and an engagement position clamping the free belt part to the guiding member, wherein when the clamping device is in the engagement position, the clamping device is brought to its releasing position by pressing on a portion of the free belt part extending along the aperture of the guiding member, wherein the clamping device comprises a control member which extends behind the guiding member of the buckle behind the portion of the free belt part that extends along the aperture of the guiding member, wherein the control member is movable from a first position to a second position to bring the clamping device from the releasing position to the engagement position and vice-versa, wherein the portion of the free belt part that extends along the aperture of the guiding member is moveable in a direction normally with respect to that aperture thereby pressing the control member from the second position to the first position.

2. The buckle assembly according to claim 1, wherein the control member is spring biased.

3. The buckle assembly according to claim 1, wherein the control member is made of spring steel.

4. The buckle assembly according to claim 1, wherein the guiding member comprises a first lateral belt guiding aperture, a second lateral belt guiding aperture extending opposite the first aperture, the apertures defining a belt passage therebetween.

5. The buckle assembly according to claim 4, wherein the fixation device is integrated with a first buckle part that includes the first lateral belt guiding aperture, and the clamping device is integrated with a second buckle part that includes the second lateral belt guiding aperture.

6. The buckle assembly according to claim 4, wherein the control member extends behind the guiding member such that the control member is in mechanical contact with a portion of the free belt part that reaches through the guiding member when the control member is in its second position.

7. The buckle assembly according to claim 1, wherein the operable clamping device comprises a first clamping part and second clamping part, the first clamping part being pivotal with respect to the second clamping part.

8. The buckle assembly according to claim 7, wherein the control member engages the first clamping part to control the position of the first clamping part with respect to the second clamping part.

9. The buckle assembly according to claim 7, wherein the first clamping part has a relatively sharp free edge to firmly grip the belt when the belt is in the engagement position.

10. The buckle assembly according to claim 7, wherein the control member has a first steady state in which the control member has concave curvature in a first direction facing outwardly, and a second steady state in which the control member has a second convex curvature in a second direction facing outwardly that is opposite to the first curvature.

11. A buckle assembly for a belt, the buckle assembly comprising:

a buckle;

a fixation device disposed on the buckle fixing the buckle to a first end of the belt; and a guiding member having an aperture, the guiding member guiding a free belt part along the first end of the belt;

wherein the guiding member includes an operable clamping device having a releasing position releasing the belt, and an engagement position clamping the free belt part to the guiding member, wherein the clamping device is brought to its releasing position by pressing on a portion of the free belt part extending along the aperture of the guiding member, wherein the clamping device comprises a control member that is movable from a first position to a second position to bring the clamping device from the releasing position to the engagement position and vice-versa, wherein the control member is made of spring steel, and is spring biased, wherein a portion of the free belt part that extends along the aperture of the guiding member is movable in a direction normally with respect to that aperture thereby pressing the control member from the second position to the first position.

12. An assembly comprising at least one belt and a buckle assembly, said buckle assembly comprising:

a buckle;

a fixation device disposed on the buckle fixing the buckle to a first end of the belt; and a guiding member having an aperture, the guiding member guiding a free belt part along the first end of the belt;

wherein the guiding member includes an operable clamping device having a releasing position releasing the belt, and an engagement position clamping the free belt part to the guiding member, wherein when the clamping device is in the engagement position, the clamping device is brought to its releasing position by pressing on a portion of the free belt part extending along the aperture of the guiding member;

wherein the clamping device comprises a control member which extends behind the guiding member of the buckle behind the portion of the free belt part that extends along the aperture of the guiding member, wherein the control member is movable from a first position to a second position to bring the clamping device from the releasing position to the engagement position and vice-versa, wherein the portion of the free belt part that extends along the aperture of the guiding member is moveable in a direction normally with respect to that aperture thereby pressing the control member from the second position to the first position.

* * * * *